United States Patent [19]

Clark

[11] 3,969,260

[45] *July 13, 1976

[54] CORROSIVE INHIBITOR COMPOSITIONS

[75] Inventor: Herbert D. Clark, Burbank, Calif.

[73] Assignee: Universal Oil Products Company, Des Plaines, Ill.

[ * ] Notice: The portion of the term of this patent subsequent to Dec. 11, 1990, has been disclaimed.

[22] Filed: July 3, 1974

[21] Appl. No.: 485,668

[52] U.S. Cl. ..... 252/147; 210/58; 252/82; 252/181; 252/389 A

[51] Int. Cl.[2] ..... C11D 7/60; C23G 1/04

[58] Field of Search ..... 252/181, 146, 147, 82, 252/389 A, 396; 210/58

[56] References Cited

UNITED STATES PATENTS

| | | | |
|---|---|---|---|
| 3,382,179 | 5/1968 | Keeney et al. | 252/396 |
| 3,778,377 | 12/1973 | Clark | 252/181 |

*Primary Examiner*—Mayer Weinblatt
*Assistant Examiner*—Edith R. Buffalow
*Attorney, Agent, or Firm*—James R. Hoatson, Jr.; William H. Page, II; Raymond H. Nelson

[57] ABSTRACT

A synergistic mixture comprising an alkynyl cycloalkanol and N,N'-dicycloalkyl-thiourea and polyaminomethylenephosphonate is used as an inhibitor in protecting metals from acid attack when cleaning said metals with an acid solution.

6 Claims, No Drawings

CORROSIVE INHIBITOR COMPOSITIONS

BACKGROUND OF THE INVENTION

Metals which are used to form apparatuses comprising recirculating water systems, steam boilers and other related equipment are subject to the formation of scale which are water-formed deposits. For example, in one illustrative example the scale which is formed on the surfaces of these systems would be the calcium carbonate scale which builds up during the use of the aforesaid equipment. One method of removing scale deposits from the metal surfaces of, for example, a recirculating cooling water system consists in treating the metal with a hydrochloric acid solution. However, during this acid cleaning procedure, extreme care must be observed in order to protect the metal against being eaten away or eroded by the acid. In addition to the descaling operation, similar precautions must be exercised in other acid cleaning operations or in acid pickling operations whereby the metal must not be harmed and must be protected against excessive destruction by the acid during the cleaning steps. Therefore, in order to protect these metals from acid attack while descaling or engaging in other operations, various inhibitors must be added to the acid and made a part of the formulation.

This invention relates to novel inhibitor compositions which are added to an acid solution and which serve to protect the metal when said acid solution is used in a metal cleaning operation. More particularly, the invention is concerned with a novel synergistic mixture of compounds whereby the metal which is being treated will be protected to a greater extent by the use thereof than when utilizing one or both of the other components of the synergistic mixture.

As hereinbefore set forth, it is imperative that the metal which is utilized in various cooling systems, either once through or recirculating in nature, steam boilers, etc. must be protected against corrosive attack when being treated with an acid solution in a descaling or cleaning operation. A particular application in which the novel synergistic inhibitor mixture of the present invention may be used is the removal of scale deposits in boilers which are used to generate steam or in cooling water systems or other operations.

Scale deposits tend to and are formed by the polyvalent ions which are contained in the water. The deposits which form the scale usually comprise salts such as calcium sulfate, calcium carbonate, the corresponding barium salts, etc. Although heretofore metal protecting inhibitors have been added to the acid solutions to protect the metals from acid attack when subjecting the systems to a cleaning operation, it will be hereinafter shown in greater detail that it has now been discovered that a novel synergistic mixture may be prepared which will protect the metal from acid attack to a much greater degree than has heretofore been expected.

It is therefore an object of this invention to provide a novel inhibitor composition.

A further object of this invention is to provide a novel synergistic mixture which acts as a corrosion inhibitor and will prevent the attack of metals from a corrosive action resulting from the use of acid solution in a cleaning operation.

In one aspect, an embodiment of this invention resides in the synergistic mixture of from about 30% to about 40% by weight of an alkynyl cycloalkanol, of from about 30% to about 40% by weight of an N,N'-dicycloalkyl-thiourea and from about 30% to about 40% by weight of polyaminomethylenephosphonate.

A specific embodiment of this invention resides in a synergistic mixture of from about 30% to about 40% by weight of ethynyl cyclohexanol, from about 30% to about 40% by weight of N,N'-dicyclohexyl-thiourea which is prepared as a composition containing from about 5% to about 20% by weight of N,N'-dicyclohexyl-thiourea, from about 40% to about 80% by weight of N,N'-dimethylacetamide and from about 5% to about 30% by weight of polyoxyethylene or polyoxypropylene derivatives and from about 30% to about 40% by weight of polyaminomethylenephosphonate.

Another specific embodiment of this invention relates to a method for removing scale from a metal surface in a boiler used to generate steam from water which comprises treating said surface with an acid solution containing a synergistic mixture of from about 30% to about 40% by weight of an alkynyl cycloalkanol, of from about 30% to about 40% by weight of an N,N'-dicycloalkyl-thiourea and from about 30% to about 40% by weight of polyaminomethylenephosphonate.

Other objects and embodiments will be found in the following further detailed description of the invention.

As hereinbefore set forth, the present invention is concerned with a novel synergistic mixture of compounds which act as inhibitors in protecting metals from acid attack when the metals are subjected to a cleansing operation to remove water-formed deposits from the surface thereof. One component of the novel synergistic mixture will comprise an alkynyl cycloalkanol in which the alkynyl portion of the molecule will contain from about 2 to about 5 carbon atoms and the cycloalkanol portion of the molecule will contain from 3 to about 8 carbon atoms in the ring. Some specific examples of these compounds will include ethynyl cyclopropanol, ethynyl cyclobutanol, ethynyl cyclopentanol, ethynyl cyclohexanol, ethynyl cycloheptanol, ethynyl cyclooctanol, propynyl cyclopropanol, propynyl cyclobutanol, propynyl cyclopentanol, propynyl cyclohexanol, propynyl cycloheptanol, propynyl cyclooctanol, butynyl cyclopropanol, butynyl cyclobutanol, butynyl cyclopentanol, butynyl cyclohexanol, butynyl cycloheptanol, butynyl cyclooctanol, pentynyl cyclopropanol, pentynyl cyclobutanol, pentynyl cyclopentanol, pentynyl cyclohexanol, pentynyl cycloheptanol, pentynyl cyclooctanol, etc. Of the aforementioned alkynyl cycloalkanols the preferred compound comprises ethynyl cyclohexanol.

The second component of the synergistic mixture of inhibitor compounds comprises an N,N'-dicycloalkyl-thiourea. The dicycloalkyl derivatives may contain from 3 to about 12 carbon atoms in the cycloalkyl ring, the preferred compound comprising N,N'-dicyclohexyl-thiourea. The aforementioned N,N'-dicycloalkyl-thiourea preferably is utilized as a 5% to 25% by weight solution or suspension in a water soluble solvent, emulsifier, dispersant, or the like.

Any suitable water soluble solvent, emulsifier, dispersant or the like may be used and may be selected from one or more of the following: (1) alcohols including methanol, ethanol, propanol, butanol, etc., (2) glycols including ethylene glycol, diethylene glycol, propylene glycol, dipropylene glycol, dimethylethylene glycol, trimethyldiethylene glycol and higher molecular weight polyethylene glycols or polypropylene glycols, (3) ketones including acetone, methyl ethyl ketone, diethyl ketone, methyl propyl ketone, ethyl propyl ketone, dipropyl ketone, etc., (4) polyoxyethylene ether, polyoxypropylene ether, methoxy polyethylene glycol, etc., (5) dimethylformamide, dimethylacetamide, diethylacetamide, dipropylacetamide, dimethylpropionamide, diethylpropionamide, etc., or (6) mixtures thereof. A particularly preferred mixture used with the dicyclohexyl-thiourea is from about 5% to about 20% dicyclohexyl-thiourea, from about 40% to about 80% by weight of N,N'-dimethylacetamide and from about 5% to about 30% by weight of polyoxyethylene and/or polyoxypropylene derivative. The polyethylene glycols preferably have a molecular weight of from about 150 to about 1000 and more particularly from about 180 to about 800. The particular compound or compounds which are used will be selected with reference to the particular mixture of alkynyl cycloalkanol, polyaminomethylenephosphonate and dicycloalkyl-thiourea as well as the particular acid which is employed and the particular type of metal surface which is to be subjected to a cleansing operation. The combination of the dicycloalkyl-thiourea, polyaminomethylenephosphonate and the alkynyl cycloalkanol of the type hereinbefore set forth in greater detail on an active ingredient basis may be in a concentration of from about 5% to about 95% by weight and preferably from about 8% to about 60% by weight.

The third component of the synergistic mixture will comprise polyaminomethylenephosphonate. Numerous polyaminomethylenephosphonates are described in U.S. Pat. No. 3,336,221 and are incorporated herein by reference. The polyaminomethylenephosphonate may be illustrated by the following structure:

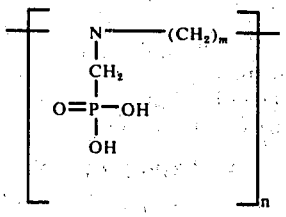

where $m$ is 1 to 3 and $n$ is 3 to 15. Also included are the ammonium or alkaline metal salts thereof, or mixtures of these. In a preferred embodiment n in the above structure is from about 8 to about 12. Typical properties of a preferred polyaminomethylenephosphonate, in which m in the above structure is 2 and n is about 10 is stated to be substantially as follows.

TABLE I

| Item | Description |
|---|---|
| Phosphorus, wt. % | 10 |
| pH | 1.0 |
| Density, pounds/gallon | 10.5 |
| Viscosity at 20° C., cps | 96 |
| Color | Dark Amber |
| Molecular weight | About 1200 |

The polyaminomethylenephosphonate will be utilized as such or prepared as a solution or dispersion in a suitable solvent, emulsifier, dispersant or the like, which may be selected from those hereinafter set forth.

The aforementioned three components of the corrosive inhibitor composition are usually present in equal amounts. However, it is also considered within the scope of this invention that the proportions of the three components may vary somewhat. Therefore, it is contemplated that the alkynyl cycloalkanol, the N,N'-dicycloalkyl-thiourea and the polyaminomethylenephosphonate may be present in varying amounts each ranging from about 30% to about 40% by weight of the finished composition.

In addition to the aforementioned three active components of the corrosive inhibitor composition, it is also contemplated that the inhibitor composition may contain a color indicator to permit visual observation of loss of potency of the inhibitor composition. For example, Methyl Violet may be included in the composition to indicate loss of potency when the color changes from violet to reddish. The amount of Methyl Violet will be sufficient for the purpose and may be used in an amount of from about 0.5 to about 10% by weight of the inhibitor composition, based on active ingredients, although lower or higher concentrations may be used as desired. It is understood that other suitable color indicators may be employed.

In a preferred method, the inhibitor mixture, with or without color indicator, is first prepared and then added to an aqueous solution of the acid. The specific amount of inhibitor composition to be included in the aqueous solution will be selected with reference to the particular use thereof. For example, when used for descaling, the inhibitor composition will be determined with regard to the amount and type of scale to be removed. The concentration of inhibitor composition may be within the range of from about 0.1 to about 1000 and preferably from about 0.1 to about 100 ppm (parts per million) based on the acid, although lower or higher concentrations may be used as desired. The appended examples illustrate suitable solutions.

As hereinbefore set forth, in one application the inhibitor composition of the present invention is used in acid solutions to remove scale formation in boilers. The scale is formed from water having high concentrations of polyvalent ions, and may comprise one or more of calcium salts, barium salts, magnesium salts, sodium salts, etc., such as the carbonate, sulfate, oxalate, silicate, etc. The scale deposits lead to plugging, pumping difficulties, loss of heat transfer, etc. Similar problems occur in cooling water systems and the removal of the scale is necessary to insure efficient operation. In another application, acid solutions are used to clean metal surfaces including, for example, in acid pickling systems. Regardless of the particular acid treatment, it is important to protect the metal from excessive loss of metal or other impairment thereof.

The acid treatment is effected in conventional manner using any suitable acid, including hydrochloric, sulfuric, phosphoric, etc. These acid treatments are well known in the industry and accordingly need not be described in detail herein. The inhibitor composition is incorporated in the acid solution in any suitable manner.

The following examples are set forth to illustrate the novelty of the corrosive inhibitor compositions of the present invention and their ability to act in a synergistic fashion. However, these examples are given merely for purposes of illustration and are not intended to limit the generally broad scope of the present invention in strict accordance therewith.

EXAMPLE I

In this example a series of evaluations were made in which various inhibitors were admixed with 460 grams of 15° Baume commercial muriatic (hydrochloric) acid and the mixture was diluted to 10% with distilled water. Zinc strips of equal dimensions and of approximately equal weight of 2.2 grams were used as the test strips. In the tests, the zinc strips were immersed in the acid solutions for a period of 21 hours at 70° F. following which the results were then compared. The N,N'-dicyclohexyl-thiourea which was used in this example comprises a commercial product which is available under the tradename "Main 33S" and is believed to comprise about 16% by weight of N,N'-dicyclohexyl-thiourea, about 60% by weight of N,N'-dimethylacetamide and the remainder of a polyoxyethylene or a polyoxypropylene derivative having a molecular weight of about 800. This compound will be designated DCT in the following table. The polyaminomethylenephosphonate which is used in this example comprises a commercial product which is available under the tradename "Fostex S" and is designated as PMP in the following table. The alkynyl cycloalkanol which was used comprises ethynyl cyclohexanol and is designated as ECH in the table. As will be noted from the following table, 3 grams of the inhibitor or mixture of inhibitors were added to the hydrochloric acid. The results of this test are set forth in Table II below.

TABLE II

| Test No. | Inhibitor | Time-Hours | Wt. Loss % |
|---|---|---|---|
| 1 | None | 2.3 | 100 |
| 2 | 3 gms DCT | 19 | 100 |
| 3 | 3 gms ECH | 4.5 | 100 |
| 4 | 3 gms PMP | 6.25 | 100 |
| 5 | 1.5 gms DCT<br>1.5 gms ECH | 21 | 12.5 |
| 6 | 1.5 gms DCT<br>1.5 gms PMP | 21 | 39.1 |
| 7 | 1.5 gms PMP<br>1.5 gms ECH | 6.5 | 100 |
| 8 | 1.0 gms ECH<br>1.0 gms PMP<br>1.0 gms DCT | 21 | 6.0 |

It is readily apparent from the above-table that when no inhibitor was present the zinc strip was completely destroyed in 2.3 hours while when the individual components of the novel corrosive inhibitor composition of the present invention were added the zinc strip was completely destroyed in times ranging from 4.5 hours to 19 hours. Likewise, when only the polyaminomethylenephosphonate and the ethynyl cyclohexanol were present the strip was also completely destroyed in 6.5 hours. In contradistinction to these figures it will be noted that a considerable reduction in weight loss was obtained when equal amounts of the three components of the novel corrosive inhibitor composition were present, the results of Test 8 showing that only a 6% weight loss occurred during the 21 hour period. This also contrasts to the results of Tests 5 and 6 which show twice as much weight loss and over 6 times as much weight loss occurring during the same period when only two components of the mixture were present in equal amounts.

EXAMPLE II

To illustrate the efficacy of the novel corrosion inhibitor compositions of the present invention a second series of tests were performed in a manner similar to that hereinbefore set forth. In this test, mild steel strips of equal dimensions and an approximate equal weight of 11 grams were used. The acid solutions in which the steel strips were immersed consisted of 20% distilled water solution of 15° Baume commercial hydrochloric acid, the amounts of the corrosion inhibitors being shown in Table III below to 460 grams of acid. Each strip was immersed in the acid solution for a period of 24 hours at a temperature of 65° C. The results of this test are shown in Table III below.

TABLE III

| Test No. | Inhibitor | Wt. Loss % |
|---|---|---|
| 1 | None | 67.0 |
| 2 | 2 gms DCT | 3.5 |
| 3 | 2 gms ECH | 2.1 |
| 4 | 2 gms PMP | 1.8 |
| 5 | 1 gm DCT<br>1 mg ECH | 0.7 |
| 6 | 1 gm PMP<br>1 gm ECH | 2.7 |
| 7 | 1 gm DCT<br>1 gm PMP | 1.1 |
| 8 | 0.7 gm ECH<br>0.7 gm DCT<br>0.7 gm PMP | 0.2 |

As in the results set forth in Table II the results in Table III clearly indicate that a combination of the three components of the corrosion inhibitor composition exhibit a synergistic action in the prevention of corrosion resulting from immersion in an acid solution, the weight loss of the steep strip when immersed in a hydrochloric acid solution which contains 2.1 grams of equal amounts of ethynyl cyclohexanol, N,N'-dicyclohexyl-thiourea and polyaminomethylenephosphonate being only 0.2. The weight loss which is shown in Tests 5, 6 and 7 show that said losses range from 3 times greater to 13 times greater when only two components of the mixture are present and correspondingly greater percentages of weight loss when only one component of the mixture is present.

EXAMPLE III

In like manner when equal amounts of propynyl cyclohexanol, N,N'-dicyclohexyl-thiourea and polyaminomethylenephosphonate as well as equal amounts of ethynyl cyclopentanol, N,N'-dicyclohexyl-thiourea and polyaminomethylenephosphonate are admixed and used as corrosion inhibitors in acid solutions, it will be found that the aforesaid mixtures will exhibit a synergistic effect with relation to the weight loss of strips of zinc or mild steel which are immersed in hydrochloric acid solutions as compared to the weight loss which is exhibited when the aforesaid strips are treated with a hydrochloric acid solution which does not contain any corrosion inhibitor or where the hydrochloric acid solution contains only one or more of the aforesaid components of the mixture, the weight loss of the strips which are treated with an acid solution containing the synergistic mixture being extremely small.

I claim as my invention:

1. The synergistic mixture of from about 30% to about 40% by weight of a lower alkynyl cycloalkanol, of from about 30% to about 40% by weight of an N,N'-dicycloalkyl-thiourea and from about 30% to about 40% by weight of polyaminomethylenephosphonate.

2. The mixture of claim 1 in which said alkynyl cycloalkanol is ethynyl cyclohexanol.

3. The mixture of claim 1 in which said alkynyl cycloalkanol is propynyl cyclohexanol.

4. The mixture of claim 1 in which said alkynyl is ethynyl cyclopentanol.

5. The mixture of claim 1 in which said N,N'-dicycloalkyl-thiourea is N,N'-dicyclohexyl-thiourea.

6. The method of removing scale from a metal surface in a boiler used to generate steam from water which comprises treating said surface with an acid solution containing the synergistic mixture of claim 1.

* * * * *